United States Patent [19]

Simpson

[11] Patent Number: 4,495,752

[45] Date of Patent: Jan. 29, 1985

[54] CONTROL HALTER WITH SLIDING HEADPIECE

[75] Inventor: Roy G. Simpson, Cookeville, Tenn.

[73] Assignee: Adams Plastics, Cookeville, Tenn.

[21] Appl. No.: 514,163

[22] Filed: Jul. 15, 1983

[51] Int. Cl.[3] ..... B68B 1/02

[52] U.S. Cl. ..... 54/24

[58] Field of Search ..... 54/6 R, 6 A, 12, 14, 54/15, 24, 35, 71

[56] References Cited

U.S. PATENT DOCUMENTS

| | | | |
|---|---|---|---|
| 291,365 | 1/1884 | Lighthouse | 54/6 A |
| 483,594 | 10/1892 | Averill | 54/24 |
| 887,862 | 5/1908 | Spangenberg | 54/24 |
| 3,237,374 | 3/1966 | Irion | 54/15 |
| 3,605,384 | 9/1971 | Pacini | 54/24 |
| 3,731,456 | 5/1973 | Hill | 54/24 |

*Primary Examiner*—Robert P. Swiatek

*Attorney, Agent, or Firm*—Luedeka & Neely

[57] ABSTRACT

The specification discloses a control halter to be used beneath a bridle to develop and maintain correct head set in a riding or performance horse. The control halter is connected to a tie-down which is in turn connected to a breast collar or the cinch of the saddle. The control halter includes a fixed headstall and a sliding headpiece. The fixed headstall includes a nosepiece supported by a crownpiece and two cheek-pieces. Two rings are incorporated into the nosepiece on either side of the horse's head and two additional rings are used to attach the crownpiece to the cheek-pieces. The lower end of the cheek-pieces are attached to the rings of the nosepiece. The sliding headpiece fits over either the forehead or the poll of the horse and each end of the sliding headpiece passes through the rings on each side of the horse's head. Both ends of the sliding headpiece have rings which may be attached to the tie-down by means of a conway buckle. The control halter of the present invention maintains the proper head position without interfering with lateral control of the horse.

7 Claims, 5 Drawing Figures

CONTROL HALTER WITH SLIDING HEADPIECE

The present invention relates to horse tack and particularly relates to a control halter for use in conjunction with a tie-down for developing and maintaining correct head set in a riding or performance horse.

The development and maintenance of correct head set in a riding horse is very important. The horse uses its head and neck to balance itself and must have its eyes in good position to see where it is going. Horses often have a tendency to excessively raise their heads or to extend their heads too far forwardly. This behavior may have undesirable effects on the performance and safety of the horse.

Many types of devices have been used for the development and maintenance of correct head set. Various types of martingales and draw reins have been used to train a horse to hold its head in the proper position or to maintain proper head position. Martingales are generally fastened at one end to the cinch of the saddle or to a breast collar and the other end connects either to the reins or to a nosepiece on the bridle. A standing martingate or tie-down is a single strap running from the cinch or breast collar to a noseband, bosal, or halter on the horse's head. Tie-downs are sometimes ineffective because they interfere with lateral control, that is, the horse is restrained from moving his head laterally as well as the intended vertical and forward restraint. Moreover, since the tie-down is generally attached only to a noseband at a position where the horse is not particularly sensitive, a tie-down is not particularly effective for developing and maintaining correct headset.

Thus, a need has arisen for a control halter for use with a tie-down which is more effective in the development and maintenance of correct head set. A device is needed which can apply pressure to a more sensitive area of a horse's head such as the brow or poll. In addition, the control halter should be operable for use underneath a standard bridle and bit and should minimize interference with lateral control of the horse.

In accordance with one form of the present invention, there is provided a control halter for use with a tie-down to develop and maintain correct headset in a riding horse including a fixed headstall with nosepiece fitted on the head of the horse. The tie-down is attached to a sliding headpiece which passes over the head of the horse. The headpiece is slidably mounted on the fixed headstall so that a downward force is exerted on the head of the horse when the horse raises its head or moves its head forward. Also, when the horse raises its head or moves its head forward, a downward and backward force is exerted on the horse's nose.

In accordance with a more particular form of the present invention, there is provided a control halter for use in conjunction with a tie-down to develop and maintain correct head set in a riding horse, including a nosepiece around the nose of the horse, a crownpiece passing over the poll of the horse, and two cheek-pieces which are disposed on either side of the horse's head and connect the nosepiece to the crownpiece. A sliding headpiece is slidably attached to the halter and passes over the head of the horse either at the brow or at the poll. The headpiece has two downwardly extending sections along the side of the horse's head which are both attached to the tie-down. The two downwardly extending sections are slidingly attached to the control halter adjacent to the noisepiece.

In accordance with a more particular aspect of the present invention a control halter is provided which further includes right and left nosepiece rings incorporated into the circumference of the nosepiece and right and left crown rings attached to the ends of the crownpiece. A right cheek-piece connects between the right nosepiece ring and the right crown ring, and the other cheek-piece, the left cheek-piece connects between the left nosepiece ring and the left crown ring. A sliding headpiece has a midsection extending over the head of the horse to the right and left crown rings. The sliding headpiece also has right and left cheek portions extending from the crown rings to the nosepiece rings. Two end portions of the sliding headpiece extend from the nosepiece rings to the tie-down. The sliding headpiece passes through the rings to be slidingly attached to the halter. The cheek-pieces, the crownpiece, and the sliding headpiece may all be made of flexible metal cable having a resilient covering thereover, and the nosepiece may have a front section made from flexible metal cable having a resilient covering extending over the horse's nose. This front section connects the nosepiece rings, and a rear section of the nosepiece is made from an adjustable strap which extends under the horse's nose and connects the nosepiece rings.

The present invention may best be understood by reference to the following detailed description when considered in conjunction with the accompanying drawings in which.

Figure 1:
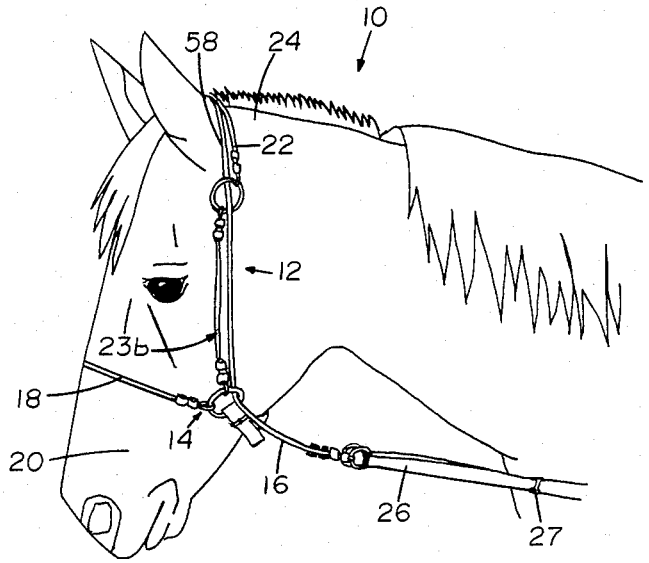
FIG. 1 is a perspective view of a horse's head in which one form of the control halter embodying the present invention has been fitted with the sliding headpiece passing over the poll.

Referring now to the drawings in which like reference characters designate like or corresponding parts throughout the several views, there is shown in FIG. 1, a perspective view of a horse's head 10 on which one form of the control halter 12 embodying the present invention has been fitted. The control halter 12 includes a fixed headstall 14 and a sliding headpiece 16. The fixed headstall 14 has a nosepiece 18 which encircles the nose 20 of the horse. A crownpiece 22 of the fixed headstall 14 passes over the poll 24 of the horse. Cheek-pieces **23*a* and 23*b* connect the crownpiece 22 to the nosepiece 18. (Only cheek-piece 23*b* is shown in FIG. 1**).

The sliding headpiece 16 is shown passing over the poll 24 of the horse and is slidingly attached to the fixed headstall 14. The ends of the sliding headpiece 16 extend away from the nosepiece 18 of the fixed headstall 14 and connect to a standing martingale 26 by means of a conway buckle 27, or other such fastening device. The tie-down 26 is attached either to a breast collar or the cinch of the saddle, not shown.

Figure 2:
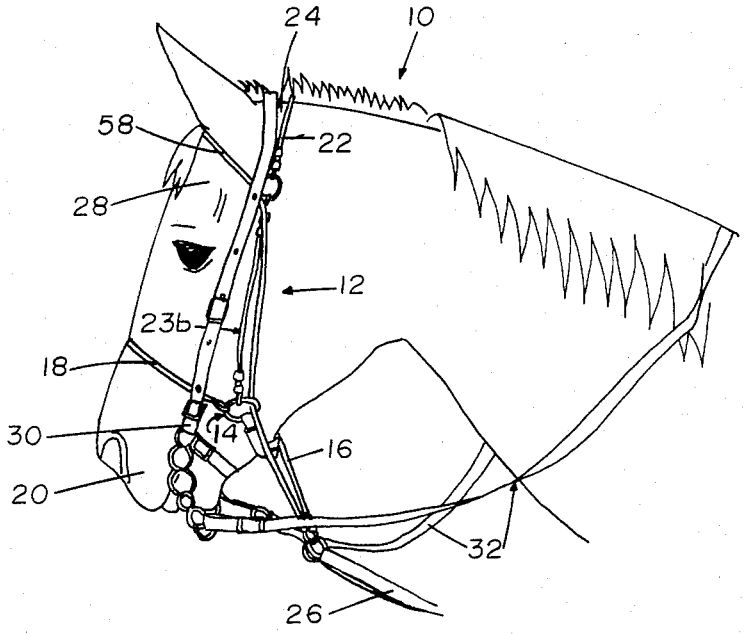
FIG. 2 is a perspective view of a horse's head in which the control halter of the present invention has been fitted with the sliding headpiece passing over the brow and further showing a bridle fitted over the control halter.

Referring now to FIG. 2, there is shown a horse's head 10 on which is fitted a control halter 12. In this drawing the sliding headpiece 16 is shown in an alternate configuration, passing over the horse's brow 28. A bridle and bit 30 are shown fitted over the control halter 12. The ends of the sliding headpiece 16 and the tie-down 26 pass between the reins 32.

Figure 3:
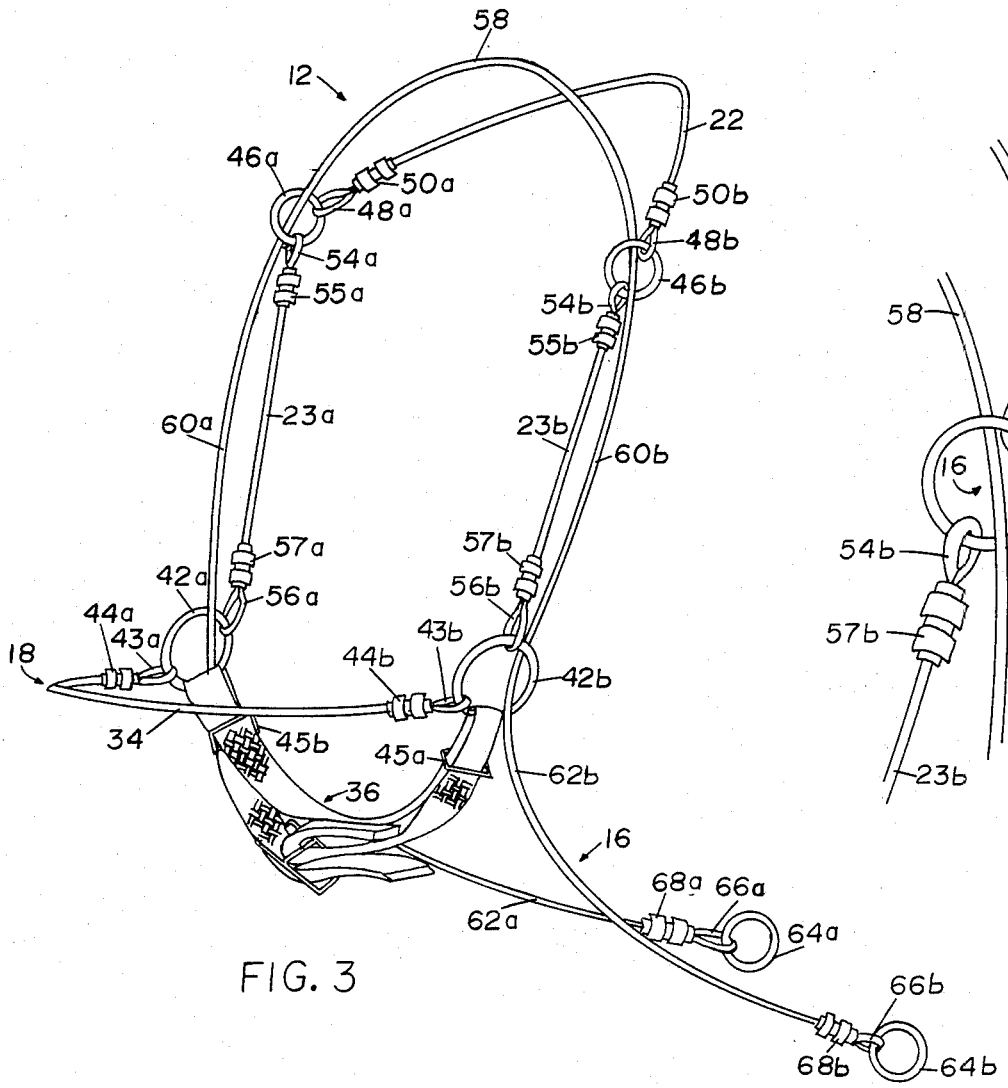
FIG. 3 is a perspective view of a control halter of the present invention with the sliding headpiece in position for passing over the brow.

Referring now to FIG. 3, the control halter 12 embodying one form of the present invention is shown. The nose-piece 18 for encircling the nose 20 of the horse is made from two sections. The front section 34 is made from flexible metal cable covered by a resilient plastic covering and is for passing over the top of the horse's nose 20. The diameter of the flexible metal cable with the covering is approximately three-sixteenth inches. As shown more clearly in FIG. 4, the rear section 36 is made from a woven strap 38 held in a circuitous configuration by a double-ended strap buckle 40. FIG. 3 shows that the rear section 36 is for passing underneath the nose 20 of the horse.

Figure 4:
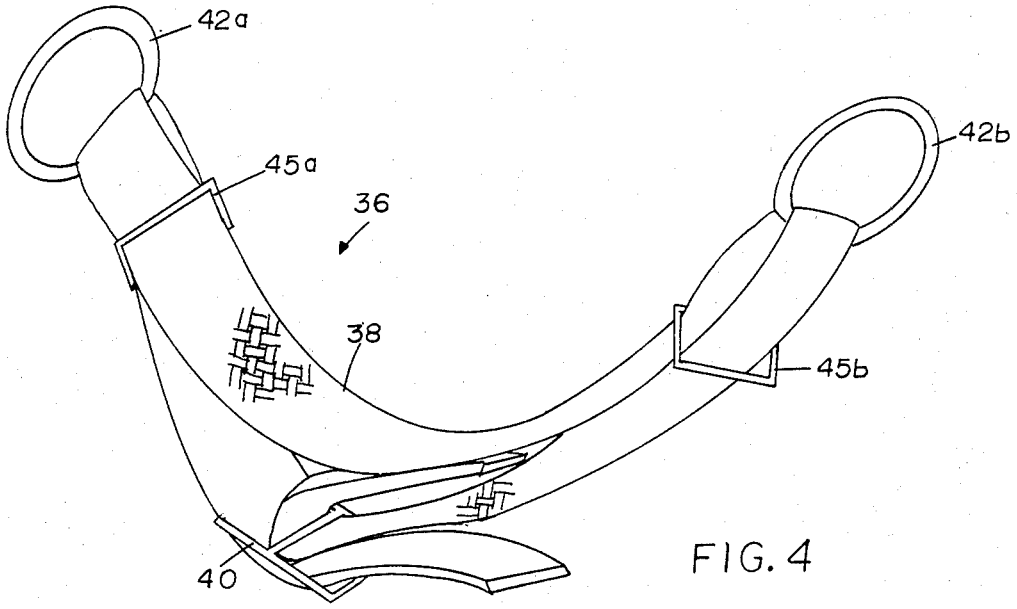
FIG. 4 is an enlarged fragmentary perspective view of the nosepiece rings of the control halter of the present invention and the lower nosepiece section.

Referring still to FIG. 3, incorporated into the nosepiece 18 are right and left nosepiece rings, **42*a* and 42*b*, respectively. (Right and left in this patent application are defined from the perspective of a rider on the horse.) The nosepiece rings 42*a* and 42*b* are made of one-quarter inch round brass rod and are approximately one and seven-eights inches in diameter. FIG. 4 shows an enlargement of the area of the right and left nosepiece rings, 42*a* and 42*b* and the rear section 36 of the nosepiece 18. FIGS. 3 and 4 show that the woven strap 38 is connected to the nosepiece ring 42*a* and 42*b* by passing through and around the nosepiece rings 42*a* and 42*b*. Right and left strap retainers, 45*a* and 45*b*, respectively, hold the strap 38 in a doubled-over configuration. The front section 34 of the nosepiece 18 is attached to the nosepiece ring by right and left loops 43*a* and 43*b*, respectively, formed by a backturned ends of front section 34 secured by cable clamps 44*a* and 44*b*. The loop 43*a* interlocks with nosepiece ring 42*a* and the loop 43*b* interlocks with nosepiece ring 42*b***.

Figure 5:
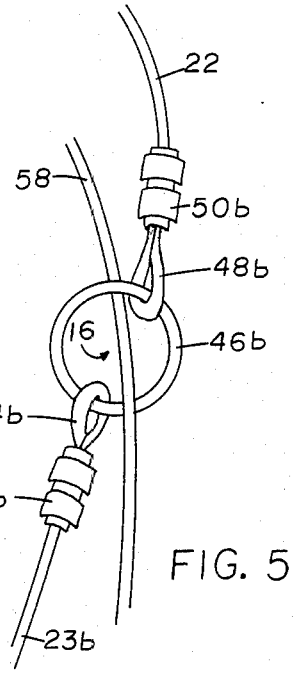
FIG. 5 is an enlarged fragmentary perspective view of the crown ring portion of the control halter of the present invention.

The crownpiece 22 is also made of three-sixteenth inch flexible metal cable covered by a resilient covering. As shown in FIG. 3, the ends of the crownpiece 22 are connected to right and left crown rings, **46*a* and 46*b*, respectively. The crown rings 46*a* and 46*b* are made of three-sixteenth inch round crome-plated steel rod and are one and three-eighths inches in diameter. The ends of the crownpiece 22 have right and left loops 48*a* and 48*b*, respectively, formed by backturned ends of the crownpiece 22 secured by cable clamps 50*a* and 50*b*. Loop 48*a* interlocks with crown ring 46*a* and loop 48*b* interlocks with crown ring 46*b*. FIG. 5 shows an enlargement of the left crown ring 46*b* including loop 48*b***.

As shown in FIG. 3, a right cheek-piece **23*a* connects between the right nosepiece ring 42*a* and the right crown ring 46*a*. A left cheek-piece 23*b* connects between the left nosepiece ring 42*b* and the left crown ring 46*b*. The cheek-pieces 23*a* and 23*b* are formed of three-sixteenth inch flexible metal cable covered with a resilient covering. Right and left upper loops 54*a* and 54*b*, respectively, on the right and left cheek-pieces, 23*a* and 23*b*, respectively, are formed from backturned upper ends of the cheek-pieces 23*a* and 23*b*, secured by cable clamps 55*a* and 55*b*. The upper loops, 54*a* and 54*b*, are interlocked with the right and left crown rings, 46*a* and 46*b*, respectively. Right and left lower loops 56*a* and 56*b*, respectively, are formed from backturned lower end of the cheek-pieces 23*a* and 23*b*, respectively, secured by cable clamps 57*a* and 57*b*. The lower loops, 56*a* and 56*b*, are interlocked with the right and left nosepiece rings, 42*a* and 42*b***, respectively.

The sliding headpiece 16 is formed from a unitary length of three-sixteenth inch flexible metal cable having a resilient covering. A midsection 58 of the sliding headpiece 16 extends between the right and left crown rings, **46*a* and 46*b*, and passes over the poll 20 as shown in FIG. 1 or over the brow 28 as shown in FIG. 2. As shown, for example, on the left side of the control halter 12 in FIG. 5, the sliding headpiece 16 extends through the left crown ring 46*b*. The sliding headpiece 16 extends through the right crown ring 46*a* similarly. As shown in FIG. 3, the sliding headpiece 16 has right and left downwardly extending sections, 60*a* and 60*b*, respecively, which extend between the crown rings, 46*a* and 46*b*, and the nosepiece rings, 42*a* nd 42*b* on both the right and left sides. On the left side of the control halter 12, the sliding headpiece 16 extends through the left nosepiece ring 42*b*. The sliding headpiece 16 extends through the right nosepiece ring 42*a* similarly. Referring still to FIG. 3 the sliding headpiece 16 has right and left end sections, 62*a* and 62*b*, respectively, which extend from the right and left nosepiece rings 42*a* and 42*b* for attachment to the tie-down 26. Attached at the ends of the end sections 62*a* and 62*b* are right and left end rings, 64*a* and 64*b*, respectively, made from three-sixteenth inch round crome-plated steel rod and having a diameter of one and three-eighths inches. The end rings 64*a* and 64*b* are attached by interlocking with right and left loops, 66*a* and 66*b*, respectively, which are formed from the backturned ends of the end sections 62*a* and 62*b* secured by cable clamps 68*a* and 68*b***.

In use, the control halter 12 is fitted over the head of the horse with the crownpiece over the poll 24 and the nosepiece 18 about the nose 20. The woven strap 38 and strap buckle 40 may be used to adjust the nosepiece 18 to fit snugly about the nose 20. The midsection 58 of the sliding headpiece 16 is positioned over either the brow 28 of the horse or the poll 24. A bridle and bit 30 are placed over the control halter 12 in a conventional fashion. The end sections **62*a* and 62*b* of the sliding headpiece 16 are passed between the reins 32 and the end rings 64*a* and 64*b* of the sliding headpiece 16 are fastened to the tie-down 26 by means of a conway buckle 27**, or by other similar means.

The length of the tie-down 26 is adjusted to achieve the proper head set by changing the position of the conway buckle 27 on the tie-down 26. Because the sliding headpiece 16 is connected to the tie-down 26, pressure is applied to either the brow 28 or poll 24 of the horse, depending on the position of the sliding headpiece 16, when the horse lifts its head. Because of the greater sensitivity of the brow 28 compared to the poll 24 of the horse, the effectiveness of the pressure applied is increased when the brow 28 position is chosen. Thus, the proper height of the horses's head may be achieved.

The sliding headpiece 16 also applies a backward and downward pressure on the nosepiece 18 when the horse lifts its head. This causes an increase in the desired quality of "flexation at the poll", that is, the nose 20 of the horse is pulled farther underneath the poll 24. Because the sliding headpiece 16 is free to slide with respect to the nosepiece rings **42*a* and 42*b* and the crown rings 46*a* and 46*b*, the force on the poll 24 or brow 28 of the horse is balanced with the backward and downward force on the nose 20** of the horse. Thus, the proper flexation at the poll in relation to head height may be achieved.

Moreover, because the sliding headpiece 16 is free to slide in the nosepiece rings 42*a* and 42*b* and the crown rings 46*a* and 46*b*, the horse is more free to turn its head than if the tie-down 26 were attached only to a nosepiece. Proper head set may be achieved with minimized interference with lateral control.

Although particular embodiments of the present invention have been described the foregoing detailed description, it will be understood that the invention is capable of numerous rearrangements, modifications and substitutions of parts without departing from the spirit of the invention.

What is claimed is:

1. A control halter for use in conjunction with a tie-down to develop and maintain a desired head set in a riding horse, comprising:

a nosepiece for being disposed about the nose of the horse;

a crownpiece for passing over the poll of the horse;

two cheek-pieces for being disposed on either side of the horse's head, said cheek-pieces being attached to and connecting between said nosepiece and said crownpiece;

a sliding headpiece having a midsection, having two downwardly extending sections for extending along the sides of the horse's head, and two ends for attachment to the tie-down; and means for slidably holding said downwardly extending sections of said sliding headpiece adjacent to the interconnection of said crownpiece and said cheek-pieces and adjacent to said nosepiece, whereby, said midsection of said sliding headpiece is selectively movable into a position for extending over the poll of the horse and into a position for extending over the brown of the horse.

2. A control halter having right and left sides for use in conjunction with a tie-down to develop and maintain a desired head set in a riding horse, comprising:

a nosepiece for being disposed about the nose of the horse;

right and left nosepiece rings incorporated into the circumference of said nosepiece, said right nosepiece ring for being disposed on the right side of the control halter adjacent to the lower cheek area of the horse, the left nosepiece ring for being disposed on the left side of halter adjacent to the lower cheek area of the horse;

a crownpiece for passing over the poll of the horse;

right and left crown rings attached at the ends of said crownpiece, the right crown ring being attached at the end of the crownpiece on the right side of the halter, the left crown ring being attached at the end of the crownpiece on the right side of the control halter;

right and left cheek-pieces, said right cheek-piece being attached to and connecting between said right nosepiece ring and said right crown ring, said left cheek-piece being attached to and connecting between said left nosepiece ring and said left crown ring;

a sliding headpiece for being slidingly disposed on the horse's head and being connected to the tie-down having a midsection, right and left cheek portions, and right and left end portions, said midsection being disposed between said right and left crown rings, the right cheek portion extending through and from said right crown ring to and through said right nosepiece ring, the left cheek portion extending through and from said left crown ring to and through said left nosepiece ring, said right end portion extending from said right nosepiece ring to the tie-down, said left end portion extending from said left nosepiece ring to the tie-down, whereby, said midsection of said sliding headpiece is selectively movable into a position over the poll of the horse and into a position extending over the brow of the horse.

3. The control halter of claim 2 wherein said cheek pieces, said crownpieces and said sliding headpiece are made of flexible metal cable having a resilient covering.

4. The control halter of claim 3 wherein said nosepiece comprises:

a front section made from flexible metal cable having a resilient covering for extending over the horse's nose and connecting the nosepiece rings; and a rear section made from adjustable woven strap for extending under the horse's nose and connecting the nosepiece rings.

5. The control halter of claim 4 wherein said front section of said nosepiece, said cheek-pieces, and said crownpiece are attached to said nosepiece rings and said crown rings by encircling said nosepiece rings and said crown rings with a loop formed from a backturned end of the flexible metal cable secured by a cable clamp.

6. The control halter of claim 2 further comprising end rings attached to the ends of said sliding headpiece, said end rings being operable for attachment to said tie-down.

7. The control halter of claim 6 wherein said end rings are attached to said sliding headpiece by encircling said end rings with a backturned end of said flexible cable secured by a cable clamp.

* * * * *